US009466311B2

(12) United States Patent
Ono et al.

(10) Patent No.: US 9,466,311 B2
(45) Date of Patent: Oct. 11, 2016

(54) AUDIO SIGNAL PROCESSING CIRCUIT AND ELECTRONIC DEVICE USING THE SAME

(71) Applicant: ROHM CO., LTD., Ukyo-ku, Kyoto (JP)

(72) Inventors: Katsuyuki Ono, Kyoto (JP); Shinji Yamagami, Ukyo-ku (JP)

(73) Assignee: ROHM CO., LTD., Ukyo-Ku, Kyoto (JP)

( * ) Notice: Subject to any disclaimer, the term of this patent is extended or adjusted under 35 U.S.C. 154(b) by 0 days.

(21) Appl. No.: 14/730,747

(22) Filed: Jun. 4, 2015

(65) Prior Publication Data

US 2015/0356964 A1 Dec. 10, 2015

(30) Foreign Application Priority Data

Jun. 9, 2014 (JP) ..... 2014-118961

(51) Int. Cl.

| | |
|---|---|
| ***G10L 21/02*** | (2013.01) |
| ***G10K 11/16*** | (2006.01) |
| ***G10L 21/0208*** | (2013.01) |
| ***H04R 3/00*** | (2006.01) |
| *G10L 21/0216* | (2013.01) |

(52) U.S. Cl.

CPC ..... *G10L 21/0208* (2013.01); *H04R 3/005* (2013.01); *G10L 2021/02166* (2013.01)

(58) Field of Classification Search

None

See application file for complete search history.

(56) References Cited

U.S. PATENT DOCUMENTS

| | | | | |
|---|---|---|---|---|
| 8,422,696 | B2 * | 4/2013 | Kim | G10K 11/175 381/110 |
| 8,812,309 | B2 * | 8/2014 | Ramakrishnan | G10L 21/0272 381/10 |
| 2008/0212794 | A1 * | 9/2008 | Ikeda | H04R 3/005 381/94.1 |
| 2010/0100374 | A1 * | 4/2010 | Park | G10L 21/0208 704/226 |
| 2012/0070015 | A1 * | 3/2012 | Oh | G10L 21/0208 381/92 |
| 2013/0016854 | A1 * | 1/2013 | Zheng | H04R 3/005 381/94.7 |
| 2013/0039503 | A1 * | 2/2013 | Beaucoup | H04M 9/082 381/66 |
| 2013/0287225 | A1 * | 10/2013 | Niwa | H04R 3/00 381/92 |
| 2013/0332157 | A1 * | 12/2013 | Iyengar | G10L 15/20 704/233 |
| 2014/0278385 | A1 * | 9/2014 | Fan | G02C 11/10 704/226 |

* cited by examiner

*Primary Examiner* — Thang Tran

(74) *Attorney, Agent, or Firm* — Cantor Colburn LLP

(57) ABSTRACT

An audio signal processing circuit and an electronic device are provided. A noise detection circuit determines if the first input audio signal and a second input audio signal contain noise. The noise cancellation circuit (i), when no noise is detected, outputs a first intermediate audio signal corresponding to the first input audio signal and a second intermediate audio signal corresponding to the second input audio signal without detected noise; (ii) when noise is detected, generates a third intermediate audio signal after performing a specific noise modification process upon the first input audio signal and the second input audio signal, and outputs the first intermediate audio signal including the third input audio signal and the second intermediate audio signal including the third input audio signal. A beamforming circuit performs a beamforming process according to a differential signal of the first intermediate audio signal and the second intermediate audio signal.

18 Claims, 7 Drawing Sheets

AUDIO SIGNAL PROCESSING CIRCUIT AND ELECTRONIC DEVICE USING THE SAME

CROSS REFERENCE TO RELATED APPLICATIONS

The present invention claims priority under 35 U.S.C. §119 to Japanese Application No. 2014-118961 filed Jun. 9, 2014, the entire content of which is incorporated herein by reference.

FIELD OF THE INVENTION

The present invention relates to an audio signal processing circuit.

BACKGROUND

For electronic devices such as digital camcorders, digital cameras, mobile phones, laptop notebooks, car navigation systems, and headsets, the functions of voice recording or voice communication can be installed thereon. To improve the directivity of the recording quality of an audio signal generated by a signal source from a specific direction, a beamforming technique is developed. The beamforming technique is capable of recording the target audio signal transmitted from a specific direction and removing the unwanted audio signals transmitted from other directions.

FIGS. 1A~1C are diagrams illustrating the beamforming technique. The audio recording system 1*r* comprises a signal processing circuit 10 and microphones 12*a*, 12*b*. The microphones 12*a*, 12*b* are non-directional microphones, which are installed along the directional axis 14 and are separated by a specific distance.

The signal processing circuit 10 receives the audio signals S1*a* and S1*b* in the form of electrical signals which are received and converted by the microphones 12*a*, 12*b* respectively. The audio signal processing circuit 10 comprises a delay element 11 for delaying the audio signal S1*b*. For clearly recording the audio signal, the audio signal processing circuit 10 performs the beamforming process to extract the target audio signal from the direction of the center of the directional axis 14. The delay amount T of the delay component 11 is set by the value such that the detecting voltage level corresponding to the audio signal in the opposite direction of the directional axis 14 is substantially zero. Since the beamforming technique is well known to those skilled in the art, the following paragraphs are the brief description of the beamforming technique and the detailed description is omitted for brevity.

FIG. 1A illustrates a circumstance where an audio source 2 has a direction the same as the directional axis 14. FIG. 1B illustrates a circumstance where the audio source 2 has a direction perpendicular to the directional axis 14. FIG. 1B illustrates a circumstance where the audio source 2 has a direction opposite to the directional axis 14. FIGS. 2A~2C illustrate the waveforms of the audio signals obtained in FIGS. 1A~1C respectively. For the sake of description, the horizontal and vertical axes of the waveforms or timing diagrams in the specification are adaptively enlarged or reduced. In addition, the waveforms are also being simplified or emphasized for the sake of description.

The two microphones 12*a* and 12*b* are only separated by a few centimeters. Therefore, the sound signals 4 generated by the audio source 2 almost have the same amplitude when the sound signals 4 are inputted into the two microphones

12*a* and 12*b*, and their phase difference $\Delta\phi$ is varied according to the direction of the audio source 2. As shown in FIG. 1A, when the direction of the audio source 2 is the same as the directional axis 14, the phase difference of the two audio signals S1*a* and S1*b* is increased. On the other hand, as shown in FIG. 1B, when the direction 16 of the audio source 2 is perpendicular to the directional axis 14, the phase difference of the two audio signals S1*a* and S1*b* is close to zero.

The gain difference (amplitude difference) and/or phase difference of the audio signals S1*a* and S1*b* outputted from the microphones 12*a* and 12*b* can be used in the beamforming technique. When the two waveforms are the same, the gain difference or the phase difference are essentially equivalent, and the difference (S1*a*-S1*b*) of the two audio signals S1*a* and S1*b* is correlated. Hence, the audio signal processing circuit 10 can collect the sound signal 4 transmitted from the directional axis 14 by processing the differential signal (S1*a*-S1*b*).

BACKGROUND TECHNICAL LITERATURE

Patent Literatures

[Patent literature 1] International patent publication number 09/025090

[Patent literature 2] International patent publication 09/044562

BRIEF SUMMARY OF THE INVENTION

Problem to be Solved in the Present Invention

The following problems are discovered after studying the high directivity audio recording system 1*r* by using the beamforming technique.

For example, when the audio recording electronic device is used with an Electret Condenser Microphone (ECM) under windy conditions, the vibrating plate in the ECM will physically vibrate due to the sound of the wind. As a result, noises from the wind are also recorded. However, noise signals mixed with the two audio signal inputs S1*a* and S1*b* will significantly disturb the gain/phase difference. Consequently, the beamforming process is also affected. The disturbance of gain/phase difference not only deteriorates noise in the noise frequency band, but also leads to significant noise from the noise frequency bands. The audio recording system will face a similar problem when using the recording system in any vibrating environment.

It is noted that the above problem is discovered by the inventors of this invention, and the problem is not a general problem faced by those skilled in the art.

Accordingly, this invention is provided to solve the above-mentioned problem. One of the objectives of the present embodiment is to provide an audio signal processing circuit capable of reducing the impact of noise.

Technical Solution

According to an embodiment of the present invention, the embodiment provides an audio signal processing circuit applicable for processing a first input audio signal and a second input audio signal received from a first microphone and a second microphone respectively. The audio signal processing circuit comprises: a noise detection circuit for determining if the first input audio signal and the second input audio signal contain noise higher than a tolerance noise level, wherein when the first input audio signal and the second input audio signal contain the noise, the noise detection circuit detects the noise and generates a noise detection signal; a noise cancellation circuit, wherein (i) when the noise detection signal is negated, the noise cancellation circuit outputs a first intermediate audio signal corresponding to the first input audio signal and a second intermediate audio signal corresponding to the second input audio signal, (ii) when the noise detection signal is affirmed, the noise cancellation circuit generates a third intermediate audio signal after performing a specific noise modification process upon the first input audio signal and the second input audio signal, and outputs the first intermediate audio signal comprising the third input audio signal, and the second intermediate audio signal comprising the third input audio signal; and a beamforming circuit for receiving the first intermediate audio signal and the second intermediate audio signal outputted from the noise cancellation circuit, and performing a beamforming process in accordance with a differential signal between the first intermediate audio signal and the second intermediate audio signal.

According to the embodiment, when the noise occurs, the noise impact can be reduced by replacing the first intermediate audio signal and the second intermediate audio signal with the third intermediate audio signal, and by providing the generated signal to the subsequent beamforming circuit.

The noise cancellation circuit performs the noise modification process targeting at each specific frequency band of the first input audio signal and the second input audio signal.

Accordingly, the embodiment can preserve the directivity of the frequency bands other than the targeting noise modification frequency bands.

The noise cancellation circuit further comprises a filter for dividing the first input audio signal and the second input audio signal into a plurality of frequency bands respectively.

The noise cancellation circuit performs the following operations: (i) when the noise detection signal is negated, the noise cancellation circuit combines the plurality of frequency bands divided from the first input audio signal, and outputs the first intermediate audio signal corresponding to the combined signal of the plurality of frequency bands divided from the first input audio signal, and combines the plurality of frequency bands divided from the second input audio signal, and outputs the second intermediate audio signal corresponding to the combined signal of the plurality of frequency bands divided from the second input audio signal; and (ii) when the noise detection signal is affirmed, the noise cancellation circuit performs the noise modification process upon a target modifying frequency band in the plurality of frequency bands of the first input audio signal and the target modifying frequency band of the second input audio signal to generate the third intermediate audio signal, and generates the first intermediate audio signal by combining the third input audio signal and other frequency bands of the first input audio signal, and further generates the second intermediate audio signal by combining the third input audio signal and other frequency bands of the second input audio signal.

The target modifying frequency band of the noise cancellation circuit comprises a frequency band of 0~500 Hz.

Therefore, the noise induced by wind or vibration can be significantly reduced.

The noise cancellation circuit performs the noise modification process targeting at all frequency bands of the first input audio signal and the second input audio signal.

The noise modification process comprises a process of computing an average value of two target modifying signals.

The average value is an unweighted average value of the two target modifying signals.

The average value can also be a weighted average value of the two target modifying signals.

Accordingly, by adjusting the values of the weighting factors, the relation between the noise reduction effect and the directivity can be optimized.

The weighting factor for a larger signal in the two target modifying signals may be less than the one for a smaller signal in the two target modifying signals.

For the two target modifying signals, the voltage level of the signal having the higher voltage level is more likely caused by the wind noise. Thus, by setting a larger weighting factor for the signal having the smaller voltage level, the target sound can dominate the output signal and the noise is reduced.

The noise modification process further comprises at least one of a process of multiplying the two target modifying signals by a specific factor or a process of multiplying the average value by the specific factor.

The specific factor is adjusted in accordance with the voltage level of the detected noise signal.

According to another embodiment of the present invention, the embodiment provides an audio signal processing circuit applicable for processing a first input audio signal and a second input audio signal received from a first microphone and a second microphone respectively. The audio signal processing circuit comprises: a filter for dividing the first input audio signal and the second input audio signal into a plurality of frequency bands respectively; a noise detection circuit for determining if the first input audio signal and the second input audio signal contain noise higher than a tolerance noise level, wherein when the first input audio signal and the second input audio signal contain the noise, the noise detection circuit detects the noise and generates a noise detection signal; and a beamforming circuit, wherein (i) when the noise detection signal is negated, the beamforming circuit performs a beamforming process targeting at all frequency bands of the first input audio signal and the second input audio signal; (ii) when the noise detection signal is affirmed, the beamforming circuit discards each target modifying frequency band of the first input audio signal and the second input audio signal, and performs the beamforming process upon the remaining frequency bands.

According to the embodiment, the noise disturbance of the differential signal of the gain/phase difference can be avoided during the beamforming process. Therefore, the noise is reduced.

An embodiment further comprises: a first amplifier for amplifying an output signal of the first microphone; a second amplifier for amplifying the output signal of the second microphone; a first A/D converter for converting the output signal of the first amplifier into the first input audio signal in digital format; and a second A/D converter for converting the output signal of the second amplifier into the second input audio signal in digital format.

In one embodiment, the audio signal processing circuit is integrated as a chip on a semiconductor substrate. The chip may comprise all of the required components of the audio signal processing circuit, or just comprise the main components of the audio signal processing circuit. In practice, partial resistors or capacitors can be installed external to the semiconductor substrate for the sake of adjustment.

Another embodiment of the present invention is an electronic device. The electronic device comprises a first channel microphone, a second channel microphone, and one of the above-mentioned audio signal processing circuits.

Those skilled in the art may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

Effects of the Present Invention

According to the audio signal processing circuit of the present invention, the noise is suppressed.

DETAILED DESCRIPTION

Figure 1C:
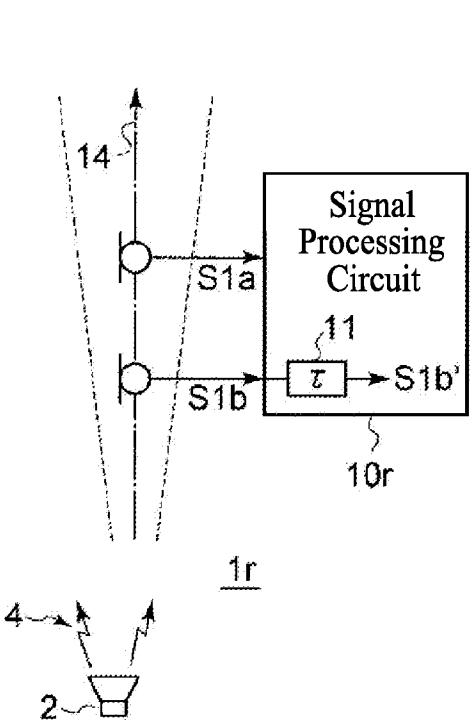
FIGS. 1A~1C are diagrams illustrating the beamforming process.

The details of one or more embodiments of the disclosure are set forth in the accompanying drawings and the description below. The present disclosure may repeat reference numerals and/or letters in the various examples. This repetition is for the purpose of simplicity and clarity and does not in itself dictate a relationship between the various embodiments and/or configurations discussed. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

It will be understood that when an element A is referred to as being "connected to" or "coupled to" another element B, it may be directly connected to or coupled to the other element, or intervening elements may be present.

Similarly, when an element C is referred to as being "connected between" or "coupled between" an element A and another element B, it may be directly connected between or coupled between the element A and the element B, or intervening elements may be present.

The First Embodiment

Figure 1B:
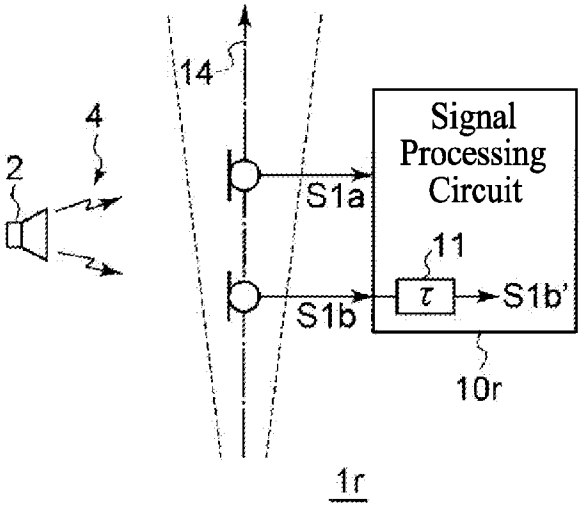
Figure 1A:
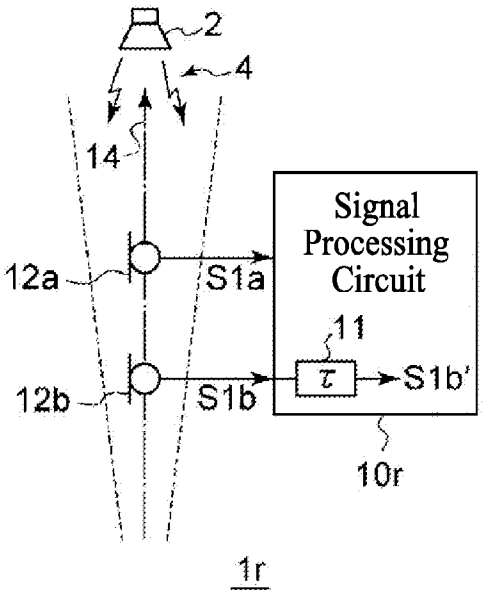
Figures 2A, 2B, 2C:
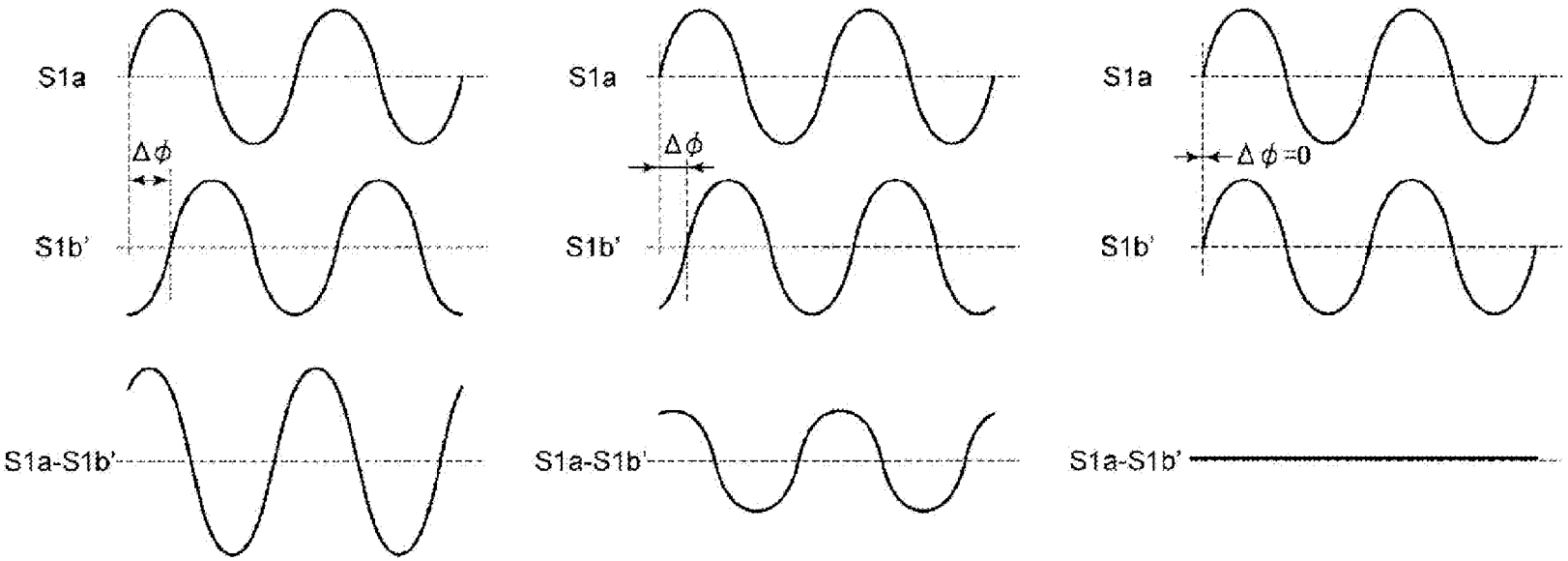
FIG. 2A~2C are diagrams illustrating the waveforms of the audio signals obtained in FIGS. 1A~1C respectively.
Figure 3:
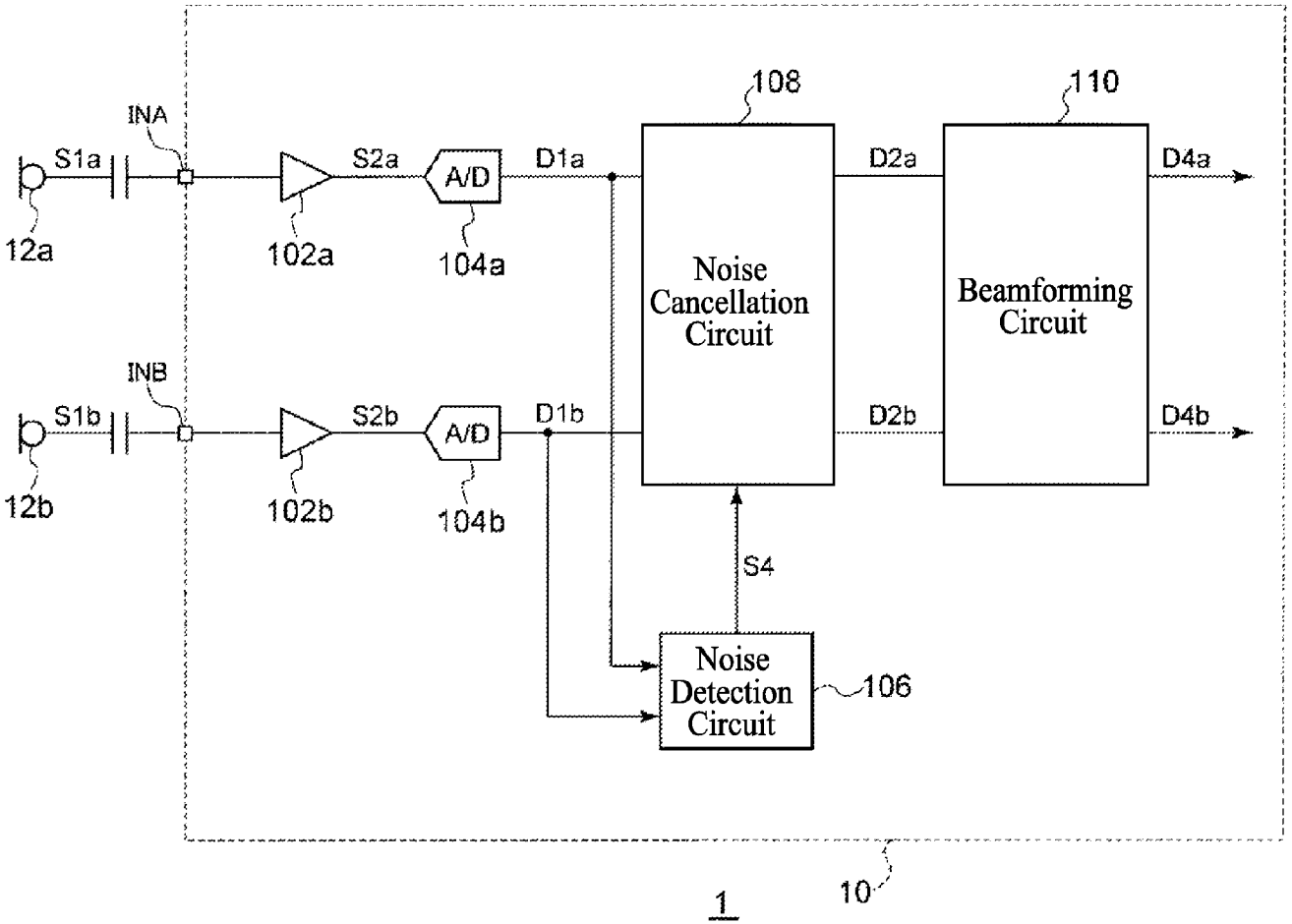
FIG. 3 is a block diagram illustrating an audio recording system having an audio signal processing circuit according to a first embodiment

FIG. 3 is a block diagram illustrating an audio recording system 1 having an audio signal processing circuit 10 according to a first embodiment. The audio recording system 1 comprises the audio signal processing circuit 10, a first microphone 12*a*, and a second microphone 12*b*. Similar to those in FIGS. 1A and 1B, the first microphone 12*a* and the second microphone 12*b* are non-directional microphones, and the first microphone 12*a* and the second microphone 12*b* are installed on the directional axis 14 and separated by a specific distance.

The audio signal processing circuit 10 receives the audio signals S1*a* and S1*b*, which are converted into the electrical signals by the first microphone 12*a* and the second microphone 12*b* respectively. In addition, for clearly recording the audio signal, the audio signal processing circuit 10 performs the beamforming process to extract the targeting audio signal from the direction of the center of the directional axis.

The audio signal processing circuit 10 comprises a first amplifier 102*a*, a second amplifier 102*b*, a first A/D converter 104*a*, a second A/D converter 104*b*, a noise detection circuit 106, a noise cancellation circuit 108, and a beamforming circuit 110. The components of the audio signal processing circuit 10 are integrated into a functional integrated circuit (IC) on a semiconductor substrate. In additional, the audio signal processing circuit 10 further comprises a microphone bias voltage circuit (not shown) for providing the bias voltages to the first microphone 12*a* and the second microphone 12*b*.

The input terminals INA and INB of the audio signal processing circuit 10 are connected to the first microphone 12*a* and the second microphone 12*b* via direct current (DC) isolating capacitors C1*a* and C2*b*, and the input terminals INA and INB receive the analog audio signals S1*a* and S1*b* from the first microphone 12*a* and the second microphone 12*b*.

The first amplifier 102*a* and the second amplifier 102*b* amplify the analog audio signals S1*a* and S1*b* respectively. The first A/D converter 104*a* and the second A/D converter 104*b* are arranged to convert the analog audio signals S2*a* and S2*b* outputted from the first amplifier 102*a* and the second amplifier 102*b* into digital audio signals D1*a* and D1*b* respectively. The audio signals D1*a* and D1*b* are the first input audio signal and the second input audio signal respectively.

The noise detection circuit 106 receives the first input audio signal D1*a* and the second input audio signal D1*b*, determines if the audio signals S1*a* and S1*b* contain noise higher than a tolerance noise level, and generates a noise detection signal S4 indicating the detection result. For example, if the noise is detected, the noise detection circuit 106 asserts the noise detection signal S4 (e.g. a high voltage level). The embodiment does not limit the method of detecting the noise. For example, the method published in Japan patent publication 2014-060525 or any other technique can be used to detect the noise. The low frequency noise, which is induced by wind or vibration, is the preferred noise target to be detected. Specifically, the frequency band of the noise may be ranged from 0~300 Hz, 0~500 Hz, or 0~1 KHz. However, this is not a limitation of the embodiment.

The noise detection circuit 108 receives the first input audio signal D1*a* and the second input audio signal D1*b*, and outputs a first intermediate audio signal D2*a* and a second intermediate audio signal D2*b*.

When the noise detection signal S4 is negated, i.e. when the noise detection circuit 106 does not detect a noise higher than the tolerance noise level, the noise cancellation circuit 108 outputs the first intermediate audio signal D2*a* corresponding to the first input audio signal D1*a* and the second intermediate audio signal D2*b* corresponding to the second input audio signal D1*b*.

For example, when D2*a*=D1*a* and D2*b*=D1*b*, the noise detection signal S4 is negated. Then, the noise cancellation circuit 108 can directly pass through the input audio signals D1*a* and D1*b*.

Alternatively, the noise cancellation circuit 108 can also use a predefined function $f(x)=\alpha x+\beta$ with predefined parameters of $\alpha$ and $\beta$ to compute D1*a* and D1*b* for outputting D2*a* and D2*b*, i.e. D2*a*=f(D1*a*) and D2*b*=f(D1*b*).

When the noise detection signal S4 is affirmed, i.e. when the noise detection circuit 106 detects a noise higher than the tolerance noise level, the noise cancellation circuit 108 outputs a third intermediate audio signal D3 by performing a specific noise modification process upon the first input audio signal D1*a* and the second input audio signal D2*b*. Then, the noise cancellation circuit 108 outputs the first intermediate audio signal D2*a* comprising the third intermediate audio signal D3, and outputs the second intermediate audio signal D2*b* comprising the third intermediate audio signal D3.

In the embodiment, the noise modification process is capable of removing the affection caused by the low frequency noise, such as the sound of wind. The noise modification process is capable of processing all frequency bands of the two signals D1*a* and D1*b*, or just processing a specific frequency band of noise caused by of the sound of wind or the vibration. The noise modification process is to reduce the affection of the gain difference (phase difference) caused by the noise in the beamforming circuit 110. Therefore, the noise modification process can also be regarded as a phase correction or gain correction process.

For example, the noise modification process comprises a process of computing an average value of the two target modifying signals D1*a* and D1*b*. The average value Y may be an unweighted average value of the two signals D1*a* and D1*b*.

$$Y=(D1a+D1b)/2 \quad (1)$$

The noise cancellation circuit 108 may use the average value Y obtained in equation (1) as the third intermediate audio signal D3.

Alternatively, the noise cancellation circuit 108 may multiply the average value Y by a specific factor K to obtain a value Y', and the value Y' is outputted as the third intermediate audio signal D3.

$$D3=Y'=Y\times K$$

In other words, the noise modification process may calculate the average value by the equation (1) after multiplying the two target modifying signals D1*a* and D1*b* by the specific factors K respectively. The noise modification process may also calculate the average value Y by equation (1) and then multiply the average value Y by the specific factor K.

The factor K can be a fixed value or a variable value. The factor K can be adjusted to have different values. For example, K can be set by K=½ when a weaker wind is detected, or K can be set by K=¼ when a stronger wind is detected. Thus, the factor K can be adjusted in accordance with the strength of wind. In other words, the factor K can be adjusted in accordance with the voltage level of the detected noise signal. Moreover, the factor K can also be adjusted in accordance with parameters other than the voltage level of a detected noise signal.

In addition, the noise modification process can also be the root mean square (RMS) process or other processes.

The beamforming circuit 110 receives the first intermediate audio signal D2*a* and the second intermediate audio signal D2*b* from the noise cancellation circuit 108, and performs the beamforming process at least according to the differential signal (d2*a*−D2*b*) of the first intermediate audio signal D2*a* and the second intermediate audio signal D2*b*. The beamforming process can be carried out by any well-known beamforming technique, and this is not a limitation of the present invention.

The output audio signals D4*a* and D4*b* after performing the beamforming process are further outputted to the following circuit, which is not shown in the figures. The following process for the beamforming circuit 110 is not a limitation of the embodiment. For example, the following process can be that of digital processes such as a filtering process, an equalizing process, a compressing process, and/or a coding process. The processed data is then stored into a storage device.

Figure 4:
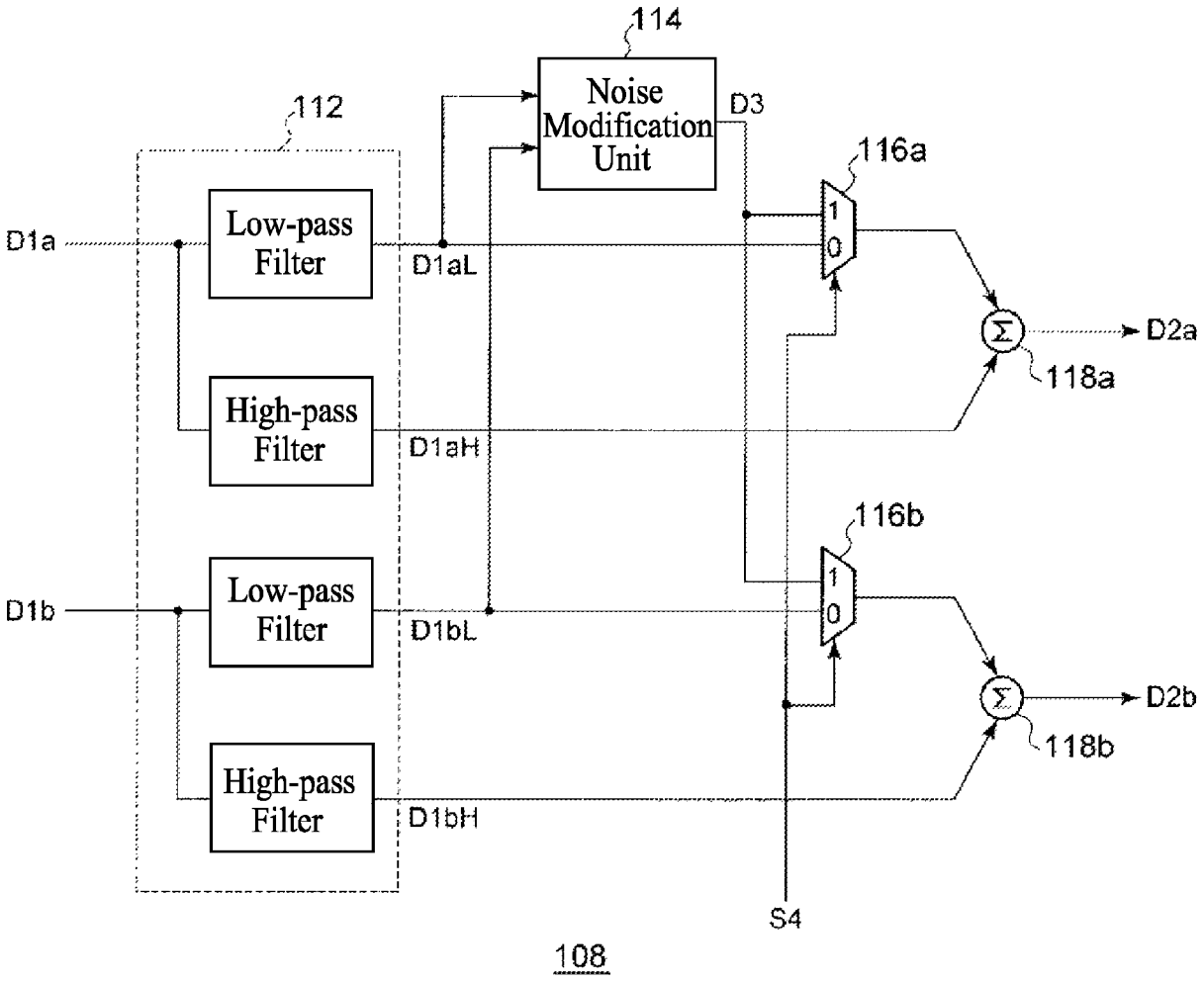
FIG. 4 is a diagram illustrating a noise cancellation circuit.

FIG. 4 is a functional diagram of the noise cancellation circuit 108. The noise cancellation circuit 108 performs the noise modification process on each specific frequency band (the targeting modification frequency band), which comprises the noise frequency, of the first input audio signal D1*a* and the second input audio signal D1*b*.

The noise cancellation circuit 108 comprises a filter 112. The filter 112 divides the first input audio signal D1*a* and the second input audio signal D1*b* into a plurality of frequency bands respectively. Furthermore, the first input audio signal D1*a* is divided into a high frequency component D1*a*H and a low frequency component D1*a*L by a low-pass filter and a high-pass filter. Similarly, the second input audio signal D1*b* is divided into a high frequency component D1*b*H and a low frequency component D1*b*L by a low-pass filter and a high-pass filter. The low frequency component can be regarded as the targeting modification frequency band.

When the noise detection signal S4 is negated (the low voltage level, 0), the noise cancellation circuit 108 combines the plurality of divided frequency bands D1*a*L and D1*a*H of the first input audio signal D1*a*, and outputs the first intermediate audio signal D2*a* corresponding to the combined signal. The combining process can also be an additive operation. In addition, the noise cancellation circuit 108 combines the plurality of divided frequency bands D1*b*L and D1*b*H of the second input audio signal D1*b*, and outputs the second intermediate audio signal D2*b* corresponding to the combined signal.

When the noise detection signal S4 is affirmed (the high voltage level, 1), the noise cancellation circuit 108 performs the noise modification process upon the targeting modification frequency band D1*a*L of the first intermediate audio signal D1*a* and the targeting modification frequency band D1*b*L of the second intermediate audio signal D1*b* for outputting the third intermediate audio signal D3. The noise cancellation circuit 108 also combines the third intermediate audio signal D3 with the other frequency bands D1*a*H of the first input audio signal D1*a* to generate the first intermediate audio signal D2*a*. Similarly, the noise cancellation circuit 108 also combines the third intermediate audio signal D3 with the other frequency bands D1*b*H of the second input audio signal D1*b* to generate the second intermediate audio signal D2*b*.

The above functions are carried out by the noise modification unit 114, the first selector 116*a*, the second selector 116*b*, the first combiner 118*a*, and the second combiner 118*b*.

The noise modification unit 114 receives the targeting modification frequency band D1*a*L of the first input audio signal D1*a* and the targeting modification frequency band D1*b*L of the second input audio signal D1*b*. Then, the noise modification unit 114 performs the specific noise modification process upon the targeting modification frequency bands to generate the third intermediate audio signal D3. The noise modification process, as described above, can be an unweighted averaging process. Therefore, the third intermediate audio signal D3 can be obtained by the following equation (2).

$$D3=(D1aL+D1bL)/2 \quad (2)$$

The first selector 116*a* receives the third intermediate audio signal D3 and the targeting modification frequency band D1*a*L of the first input audio signal D1*a*. When the noise detection signal S4 is affirmed (i.e. 1), D3 is selected. When the noise detection signal S4 is negated, D1*a*L is selected. Similarly, the second selector 116*b* receives the third intermediate audio signal D3 and the targeting modification frequency band D1*b*L of the second input audio signal D1*b*. When the noise detection signal S4 is affirmed (i.e. 1), D3 is selected. When the noise detection signal S4 is negated, D1*b*L is selected.

The first combiner 118*a* adds up the output of the first selector 116*a* and the component D1*a*H of the first input audio signal D1*a*, but not the targeting modification frequency band. Similarly, the second combiner 118*b* adds up the output of the second selector 116*b* and the component D1*b*H of the second input audio signal D1*b*, but not the targeting modification frequency band.

In addition, the noise cancellation circuit 108 is not limited to the configuration of FIG. 4. Those skilled in the art will appreciated that other modified configurations may also perform the same function. For example, the first selector 116*a* and the second selector 116*b* can be omitted, and the operation of the noise modification unit 114 is switched by the noise detection signal S4. In another example: (i) when the noise detection signal S4 is affirmed, the noise modification unit 114 outputs the third intermediate audio signal D3 to the first combiner 118*a* and the second combiner 118*b*; (ii) when the noise detection signal S4 is negated, the noise modification unit 114 does not perform the noise modification process, and outputs D1*a*L and D1*b*L to the first combiner 118*a* and to the second combiner 118*b* respectively.

Moreover, the function of the noise modification unit 114 can be implemented by hardware or a combination of embedded processors and software.

The above paragraphs describe the configuration of the audio signal processing circuit 10. The operation of the audio signal processing circuit 10 where the noise is detected and the noise is not detected is described in the following paragraphs.

1. The Noise is not Detected

When the noise induced by the sound of wind or vibration is not present, the noise detection signal S4 is negated. Then, the noise cancellation circuit 108 allows the input signals D1*a* and D1*b* to pass through, and directly outputs the input signals D1*a* and D1*b* to the following beamforming circuit 110. In other words, the noise cancellation circuit 108 does not process the input audio signals. The beamforming circuit 110 receives the original input audio signals D1*a* and D1*b* to perform the beamforming process. Therefore, when the noise is not present, the operation is similar to the above-mentioned operation.

2. The Noise is Detected

When the noise induced by the sound of wind or vibration is present, the noise detection signal S4 of the noise detection circuit 106 is affirmed. Then, the noise cancellation circuit 108 performs the noise modification process targeting at each modification frequency band of the first input audio signal D1*a* and the second input audio signal D1*b*, and accordingly generates the third intermediate audio signal D3. It is noted that the other frequency bands are allowed to pass through the noise cancellation circuit 108.

The operation of the audio signal processing circuit 10 is described in the above paragraphs.

According to the audio signal processing circuit 10, in the targeting modification frequency band, the first intermediate audio signal D2*a* and the second intermediate audio signal D2*b* become the same component signal D3. As a result, the directivity is damaged. However, the differential signal (D2*a*-D2*b*) generated in the beamforming circuit 110 can be used to repair the effect of the sound of wind or vibration. In addition, for the frequency bands other than the targeting modification frequency band, the process is similar to the above-mentioned process. Therefore, the directivity of the other frequency bands can be preserved. In other words, when the noise is detected, the frequency band of the noise is discarded from the targets of the beamforming process.

Figure 5:
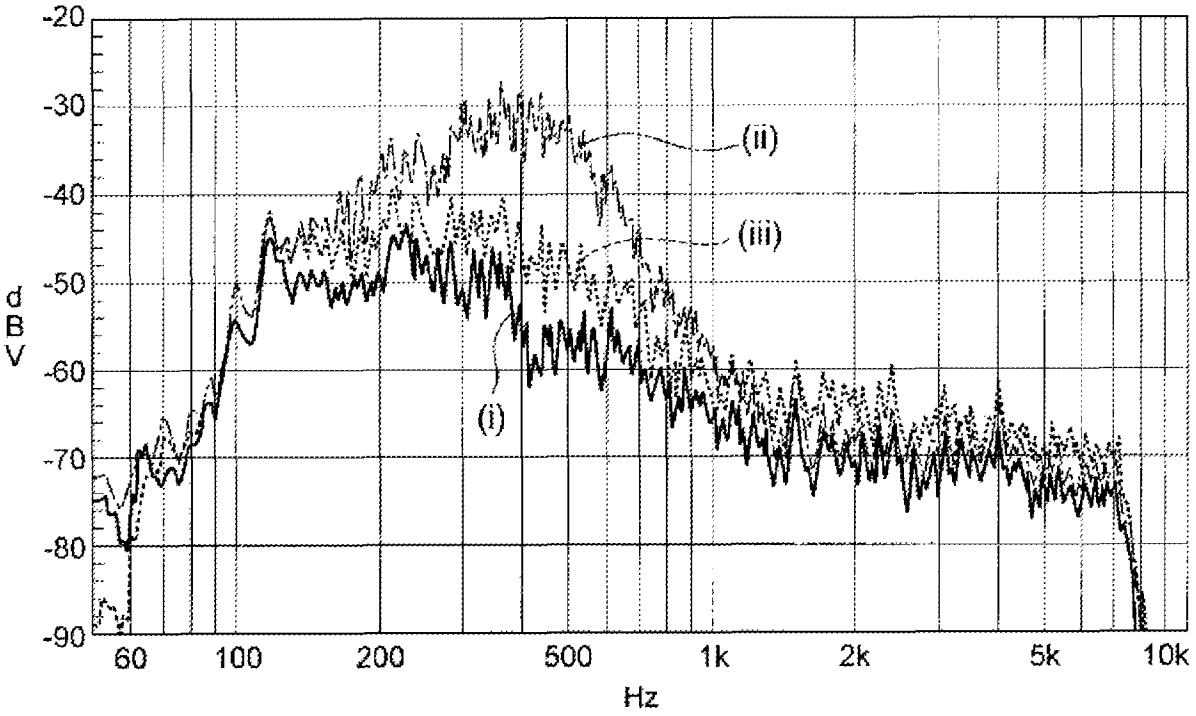
FIG. 5 is a diagram illustrating spectrums of audio signals obtained by an audio signal processing circuit.

FIG. 5 is a diagram illustrating the spectrum of the audio signal D4*a*(D4*b*) obtained by the audio signal processing circuit 10 according to the embodiment. The spectrum is obtained by inputting the target audio signal 4 into the first microphone 12*a* and the second microphone 12*b* under the condition of a wind speed of 4.5 m/s. Meanwhile, a Fast Fourier Transform (FFT) is performed upon the acquired output audio signal D4*a* (D4*b*) to obtain the spectrum.

The curve (i) as shown in FIG. 5 is a spectrum obtained by the audio signal processing circuit 10 according to an embodiment. For the sake of comparison, the curve (ii) obtained by the beamforming process and the curve (iii) obtained by the beamforming process without performing the noise modification process in the audio signal processing circuit are shown in FIG. 5.

The spectrum of the curve (ii) of the audio signal processing circuit is equivalent to the result obtained by ignoring the detection result of the noise detection circuit 106, i.e. the result obtained by just negating the noise detection signal S4. The spectrum (iii) is obtained by just ignoring the noise detection signal S4 and disabling the beamforming circuit 110 to allow signals to pass through.

According to the comparison of the curves (ii) and (iii), if the beamforming process is performed under the condition of having a noise, such as the sound of wind, then the gain difference (phase difference) of the first intermediate audio signal D2*a* and the second intermediate audio signal D2*b* is affected significantly. Thus, the noise voltage in the frequency band of 100~1 KHz is very large (i.e. (ii)). In addition, the noise voltage in the frequency band higher than 1 KHz is also seriously affected by the variation of the gain difference (phase difference).

On the contrary, although the beamforming process is performed in the embodiment, the curve (i) obtained by the audio signal processing circuit 10 can still reduce the noise voltage into a level lower than the level before performing the beamforming process, i.e. the curve (iii). It should be noted that the noise reduction process not only affects the targeting modification frequency band (0~1 KHz) of the noise modification unit 114, but also affects other higher frequency bands.

A number of different variant embodiments of the first embodiment of the audio signal processing circuit 10 are described in the following paragraphs.

First Variant Embodiment

In this embodiment, the noise modification process is an averaging process. Specifically, the averaging process is an unweighted averaging process. However, this is not a limitation of the present invention.

The average value Y may be a weighted average of the two signals D1*a* and D1*b*.

$$Y=(Ka\times D1a+Kb\times D1b)/(Ka+Kb) \quad (3)$$

Ka and Kb are weighting factors.

If Ka+Kb=1, then the following equation (3') can be obtained:

$$Y=(Ka\times D1a+Kb\times D1b) \quad (3')$$

By adjusting the values of the weighting factors Ka and Kb, the relation between the noise reduction effect and the directivity can be optimized. For example, the factors Ka and Kb can be set according to each of the signal voltage levels |D1*a*| and |D1*b*| of the first input audio signal D1*a* and the second input audio signal D1*b* respectively.

Specifically, for the two signals D1*a* and D1*b* (or D1*a*L and D1*b*L), the weighting factor for the signal having the larger signal voltage level is less than the weighting factor for the signal having the smaller signal voltage level.

When |D1*a*|>|D1*b*|, it is determined that the first input audio signal D1*a* has a larger wind noise. Then, under this circumstance, it can be concluded that the second input audio signal D1*b* has a higher ratio of target sound than the first input audio signal D1*a*. Thereafter, by setting Ka<Kb, the target sound in the second input audio signal D1*b* can dominate the extraction for generating the third intermediate audio signal D3. On the other hand, the setting is Ka>Kb if |D1*a*|<|D1*b*|.

Second Variant Embodiment

In this embodiment, the first input audio signal D1*a* and the second input audio signal D1*b* are divided into two frequency bands respectively. However, this is not a limitation of the present invention. The first input audio signal D1*a* and the second input audio signal D1*b* can also be divided into three or more frequency bands respectively.

Moreover, in this embodiment, the noise cancellation circuit 108 only performs the noise cancellation process upon the specific targeting frequency band. However, this is not a limitation of the present invention. The noise cancellation circuit 108 can also perform the noise cancellation process upon all frequency bands.

Third Variant Embodiment

In this embodiment, when the noise is detected, the low frequency component D2*a*L of the first intermediate audio signal D2*a* and the low frequency component D2*b*L of the second intermediate audio signal D2*b* become the same signal, i.e. the generation of the third intermediate audio signal D3. However, this is not a limitation of the present invention. The low frequency component D2*a*L of the first intermediate audio signal D2*a* and the low frequency component D2*b*L of the second intermediate audio signal D2*b* are not necessarily the same signal. As long as the signal contains at least the third intermediate audio signal D3, the signal belongs to the scope of the present invention. In addition, D2*a*L can be set as the sum up signal of D3 and the low frequency component D1*a*L of the first input audio signal D1*a*, and D2*b*L can be set as the sum up signal of D3 and the low frequency component D1*b*L of the second input audio signal D1*b*. In this circumstance, the directivity of the targeting modification frequency bands can be preserved.

The Second Embodiment

In the first embodiment, when the noise is detected, each of the targeting modification frequency bands of the first intermediate audio signal D2*a* and the second intermediate audio signal D2*b* are replaced by the third intermediate audio signal D3. In other words, in the first embodiment, the frequency bands are discarded from the targeting modification frequency bands during the beamforming process of the beamforming circuit 110.

Figure 6:
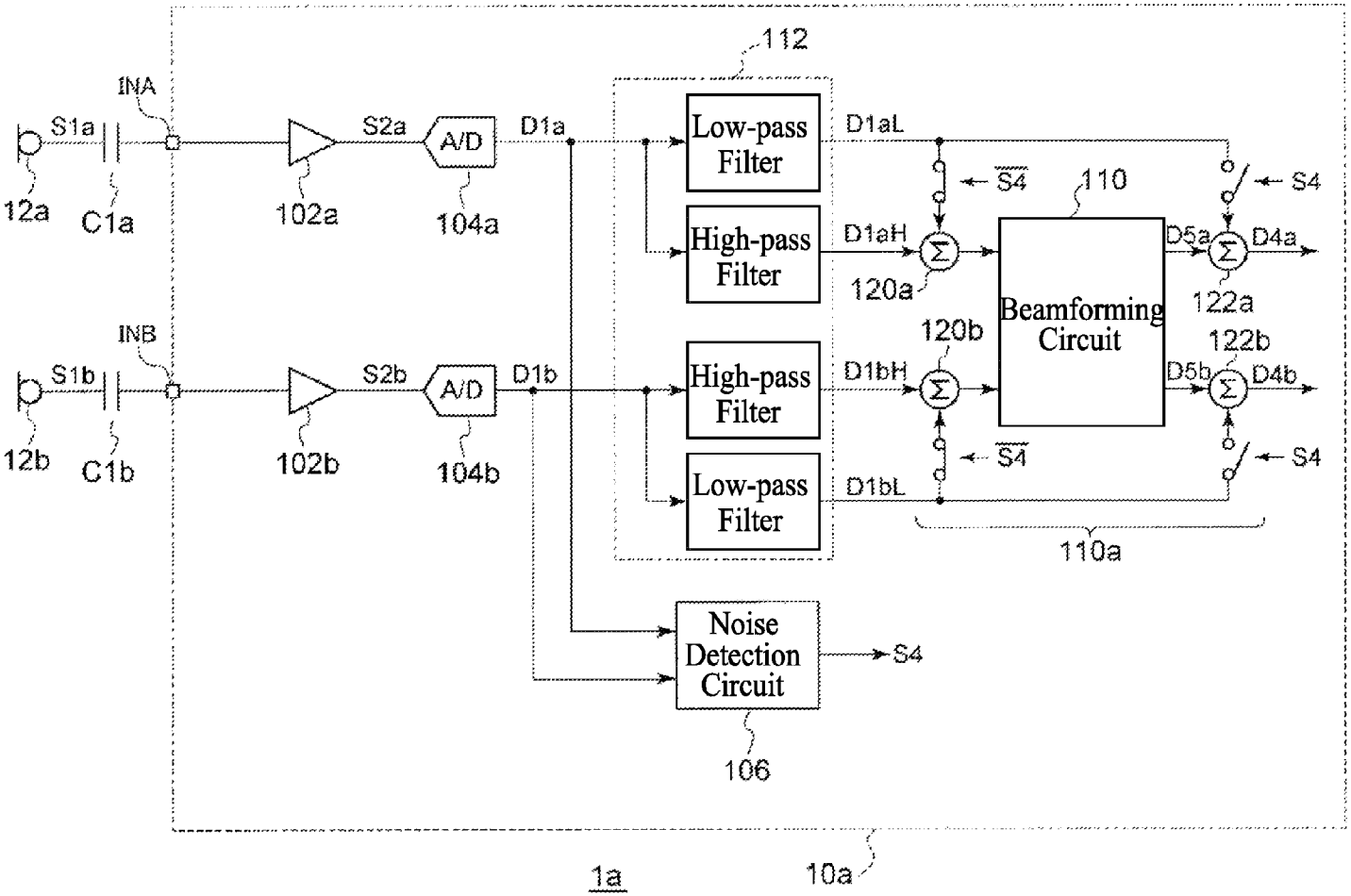
FIG. 6 is a diagram illustrating an audio recording system comprising an audio signal processing circuit according to a second embodiment.

FIG. 6 is a block diagram illustrating an audio recording system comprising an audio signal processing circuit 10*a* according to the second embodiment. The audio signal processing circuit 10*a* comprises a first amplifier 102*a*, a second amplifier 102*b*, a first A/D converter 104*a*, a second A/D converter 104*b*, a noise detection circuit 106, a filter 112, and a beamforming circuit 110*a*.

The filter 112 divides the first input audio signal D1*a* and the second input audio signal D1*b* into a plurality of frequency bands respectively.

The noise detection circuit 106 determines if the first input audio signal D1*a* and the second input audio signal D1*b* contain noise higher than a tolerance noise level. The noise detection signal S4 is affirmed when the noise is present.

The beamforming circuit 110*a* (i) performs a beamforming process targeting all frequency bands of the first input audio signal D1*a* and the second input audio signal D1*b* when the noise detection signal S4 is negated. In addition, the beamforming circuit 110*a* (ii) discards each of the targeting modification frequency bands (the low frequency region) of the first intermediate audio signal D1*a* and the second intermediate audio signal D1*b* from the targeting frequency bands of the beamforming process when the noise detection signal S4 is affirmed, and performs the beamforming process upon the remaining frequency bands (the high frequency region).

The beamforming circuit 110*a* comprises a beamforming circuit 110, a third combiner 120*a*, a fourth combiner 120*b*, a fifth combiner 122*a*, and a sixth combiner 122*b*. The function of the beamforming circuit 110 is similar to the beamforming circuit 110 of FIG. 3.

When the noise detection signal S4 is negated, the third combiner 120*a* re-combines a plurality of frequency bands D1*a*L and D1*a*H of the first input audio signal D1*a*, which are divided by the filter 112, and outputs the combined signal to the beamforming circuit 110. When the noise detection signal S4 is affirmed, the third combiner 120*a* only outputs D1*a*H to the beamforming circuit 110.

Similarly, when the noise detection signal S4 is negated, the fourth combiner 120*b* re-combines a plurality of frequency bands D1*b*L and D1*b*H of the second input audio signal D1*b*, which are divided by a filter 112, and outputs the combined signal to the beamforming circuit 110. When the noise detection signal S4 is affirmed, the fourth combiner 120*b* only outputs D1*b*H to the beamforming circuit 110.

When the noise detection signal S4 is negated, the fifth combiner 122*a* directly outputs the output signal D5*a* of the beamforming circuit 110; and when the noise detection signal S4 is affirmed, the fifth combiner 122*a* combines the signal D1*a*L with the output signal D5*a* of the beamforming circuit 110.

Similarly, when the noise detection signal S4 is negated, the sixth combiner 122*b* directly outputs the output signal D5*b* of the beamforming circuit 110; when the noise detection signal S4 is affirmed, the sixth combiner 122*b* combines the signal D1*b*L with the output signal D5*b* of the beamforming circuit 110.

According to the operation of the audio signal processing circuit 10*a*, the similar effect of the first embodiment can be obtained.

Then, the application of the audio signal processing circuit 10 is described in the following paragraphs.

Figure 7:
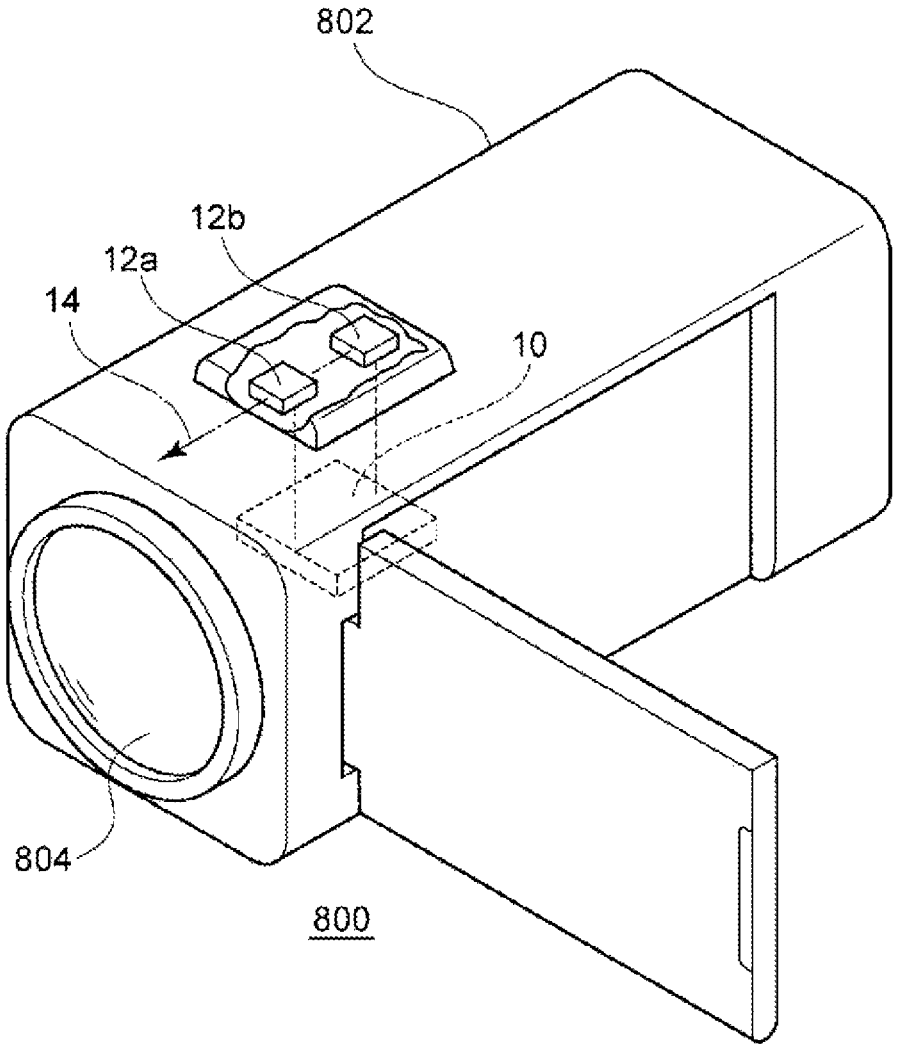
FIG. 7 is a cross-sectional diagram illustrating an electronic device using an audio signal processing circuit.

FIG. 7 is a cross-sectional diagram of an electronic device using the audio signal processing circuit 10. The electronic device in FIG. 7 is a digital camcorder, for example.

A digital camcorder 800 comprises a frame body 802, a lens 804, an image sensor (not shown), an image processor, and a storage media. In addition, the digital camcorder 800 further comprises a first microphone 12*a*, a second microphone 12*b*, and an audio signal processing circuit 10. The first microphone 12*a* and a second microphone 12*b* are installed along the directional axis 14.

In addition, the electronic equipment may also be a digital camcorder, an audio recorder, a mobile phone terminal, a smart phone, a personal handy-phone system (PHS), a personal hand-held phone system, a personal digital assistant (PDA), a laptop notebook, an input tablet terminal, an audio player, a car navigation system, a headset, or another device.

The present invention is described in accordance with a number of embodiments with clear context. Note that these embodiments simply represent the theory, principle, and application of the present invention. Those skilled in the art should also realize that there exist equivalent constructions and/or embodiments not departing from the spirit and scope of the present invention.

What is claimed is:

1. An audio signal processing circuit, applicable for processing a first input audio signal and a second input audio signal received from a first microphone and a second microphone respectively, the audio signal circuit comprising:

a noise detection circuit, for determining if the first input audio signal and the second input audio signal contain noise higher than a tolerance noise level, wherein when the first input audio signal and the second input audio signal contain the noise, the noise detection circuit detects the noise to generate a noise detection signal;

a noise cancellation circuit, wherein (i) when the noise detection signal is negated, the noise cancellation circuit outputs a first intermediate audio signal corresponding to the first input audio signal and a second intermediate audio signal corresponding to the second input audio signal; (ii) when the noise detection signal is affirmed, the noise cancellation circuit generates a third intermediate audio signal after performing a specific noise modification process upon the first input audio signal and the second input audio signal, and outputs the first intermediate audio signal comprising the third input audio signal, and the second intermediate audio signal comprising the third input audio signal; and a beamforming circuit, for receiving the first intermediate audio signal and the second intermediate audio signal outputted from the noise cancellation circuit, and performing a beamforming process in accordance with a differential signal between the first intermediate audio signal and the second intermediate audio signal.

2. The audio signal processing circuit of claim 1, wherein:

the noise cancellation circuit performs the noise modification process targeting at each specific frequency band of the first input audio signal and the second input audio signal.

3. The audio signal processing circuit of claim 1, wherein:

the noise cancellation circuit further comprises a filter for dividing the first input audio signal and the second input audio signal into a plurality of frequency bands respectively.

4. The audio signal processing circuit of claim 3, wherein for the noise cancellation circuit:

(i) when the noise detection signal is negated, the noise cancellation circuit combines the plurality of frequency bands divided from the first input audio signal, and outputs the first intermediate audio signal corresponding to the combined signal of the plurality of frequency bands divided from the first input audio signal, and combines the plurality of frequency bands divided from the second input audio signal, and outputs the second intermediate audio signal corresponding to the combined signal of the plurality of frequency bands divided from the second input audio signal; and (ii) when the noise detection signal is affirmed, the noise cancellation circuit performs the noise modification process upon a target modifying frequency band in the plurality of frequency bands of the first input audio signal and the target modifying frequency band of the second input audio signal to generate the third intermediate audio signal, and generates the first intermediate audio signal by combining the third input audio signal and other frequency bands of the first input audio signal, and further generates the second intermediate audio signal by combining the third input audio signal and other frequency bands of the second input audio signal.

5. The audio signal processing circuit of claim 2, wherein:

a target modifying frequency band of the noise cancellation circuit comprises a frequency band of 0~500 Hz.

6. The audio signal processing circuit of claim 1, wherein:

the noise cancellation circuit performs the noise modification process targeting at all frequency bands of the first input audio signal and the second input audio signal.

7. The audio signal processing circuit of claim 1, wherein:

the noise modification process comprises a process of computing an average value of two target modifying signals.

8. The audio signal processing circuit of claim 7, wherein:

the average value is an unweighted average value of the two target modifying signals.

9. The audio signal processing circuit of claim 7, wherein:

the average value is a weighted average value of the two target modifying signals.

10. The audio signal processing circuit of claim 9, wherein:

a weighting factor for a larger signal in the two target modifying signals is less than the weighting factor for a smaller signal in the two target modifying signals.

11. The audio signal processing circuit of claim 7, wherein:

the noise modification process further comprises at least one of a process of multiplying the two target modifying signals by a specific factor or a process of multiplying the average value by the specific factor.

12. The audio signal processing circuit of claim 11, wherein:

the specific factor is adjusted in accordance with a voltage level of the noise detection signal.

13. An audio signal processing circuit, applicable for processing a first input audio signal and a second input audio signal received from a first microphone and a second microphone respectively, the audio signal processing circuit comprising:

a filter, for dividing the first input audio signal and the second input audio signal into a plurality of frequency bands respectively;

a noise detection circuit, for determining if the first input audio signal and the second input audio signal contain noise higher than a tolerance noise level, wherein when the first input audio signal and the second input audio signal contain the noise, the noise detection circuit detects the noise to generate a noise detection signal; and a beamforming circuit, wherein (i) when the noise detection signal is negated, the beamforming circuit performs a beamforming process targeting all frequency bands of the first input audio signal and the second input audio signal; (ii) when the noise detection signal is affirmed, the beamforming circuit discards each target modifying frequency band of the first input audio signal and the second input audio signal, and performs the beamforming process upon the remaining frequency bands.

14. The audio signal processing circuit of claim 13, further comprising:

a first amplifier, for amplifying an output signal of the first microphone;

a second amplifier, for amplifying the output signal of the second microphone;

a first analog to digital converter, for converting the output signal of the first amplifier into the first input audio signal in digital format; and a second analog to digital converter, for converting the output signal of the second amplifier into the second input audio signal in digital format.

15. The audio signal processing circuit of claim 13, which is integrated onto a semiconductor substrate.

16. An electronic device, comprising:

a first channel microphone;

a second channel microphone; and the audio signal processing circuit of claim 14.

17. An audio signal processing method, applicable for processing a first input audio signal and a second input audio signal received from a first microphone and a second microphone, the audio signal processing method comprising:

determining if the first input audio signal and the second input audio signal contain noise higher than a tolerance noise level;

(i) when the first input audio signal and the second input audio signal are determined to not contain a noise higher than the tolerance noise level, outputting a first intermediate audio signal corresponding to the first input audio signal and a second intermediate audio signal corresponding to the second input audio signal; (ii) when the first input audio signal and the second input audio signal are determined to contain a noise higher than the tolerance noise level, generating a third intermediate audio signal after performing a specific noise modification process upon the first input audio signal and the second input audio signal, and outputting the third intermediate audio signal to be the first intermediate audio signal and the second intermediate audio signal; and receiving the first intermediate audio signal and the second intermediate audio signal, and performing a beamforming process in accordance with a differential signal between the first intermediate audio signal and the second intermediate audio signal.

18. An audio signal processing method, applicable for processing a first input audio signal and a second input audio signal received from a first microphone and a second microphone, the audio signal processing method comprising:

dividing the first input audio signal and the second input audio signal into a plurality of frequency bands respectively;

determining if the first input audio signal and the second input audio signal contain noise higher than a tolerance noise level;

(i) when the first input audio signal and the second input audio signal are determined to not contain the noise higher than the tolerance noise level, performing a beamforming process targeting all frequency bands of the first input audio signal and the second input audio signal; and (ii) when the first input audio signal and the second input audio signal are determined to contain the noise higher than the tolerance noise level, discarding each target modifying frequency band of the first input audio signal and the second input audio signal and performing the beamforming process upon the remaining frequency bands.

* * * * *